United States Patent [19]

Whitten, Jr.

[11] 3,990,167

[45] Nov. 9, 1976

[54] MEANS FOR APPLYING INDICIA TO SWIMMING POOL COMPONENTS

[76] Inventor: George R. Whitten, Jr., 82 South St., Holliston, Mass. 01746

[22] Filed: Oct. 24, 1975

[21] Appl. No.: 625,573

[52] U.S. Cl. ..... 40/125 E; 4/172.17; 40/143

[51] Int. Cl.[2] ..... G09F 7/08

[58] Field of Search ..... 40/125 E, 140, 142 R, 40/143, 130 J, 125 R, 125 N; 4/172.17, 172.18, 172.21

[56] References Cited

UNITED STATES PATENTS

| | | | |
|---|---|---|---|
| 1,272,177 | 7/1918 | Almquist et al. | 40/125 N X |
| 1,606,825 | 11/1926 | Briggs | 40/125 N X |
| 1,640,830 | 8/1927 | Hunt | 40/125 N X |
| 2,062,094 | 11/1936 | Kip | 40/125 E X |
| 2,078,926 | 5/1937 | Cornell et al. | 40/125 E |
| 2,879,614 | 3/1959 | Baldanza | 40/140 X |
| 2,880,537 | 4/1959 | Cygan | 40/140 X |
| 3,918,107 | 11/1975 | Whitten et al. | 4/172.17 |

*Primary Examiner*—John F. Pitrelli

[57] ABSTRACT

A device is disclosed for applying indicia to swimming pool components of the type having laterally spaced grill members. The device includes a channel-shaped cap member having spaced opposed resilient side flanges connected by an intermediate flat web. The aforesaid flanges have inwardly protruding longitudinal ribs arranged to snap into grooves in the side walls of the grill members. The cap members may be cut to appropriate lengths and applied to the grill members in appropriate patterns to thereby develop desired indicia, for example depth markings, lane markings, etc.

7 Claims, 4 Drawing Figures

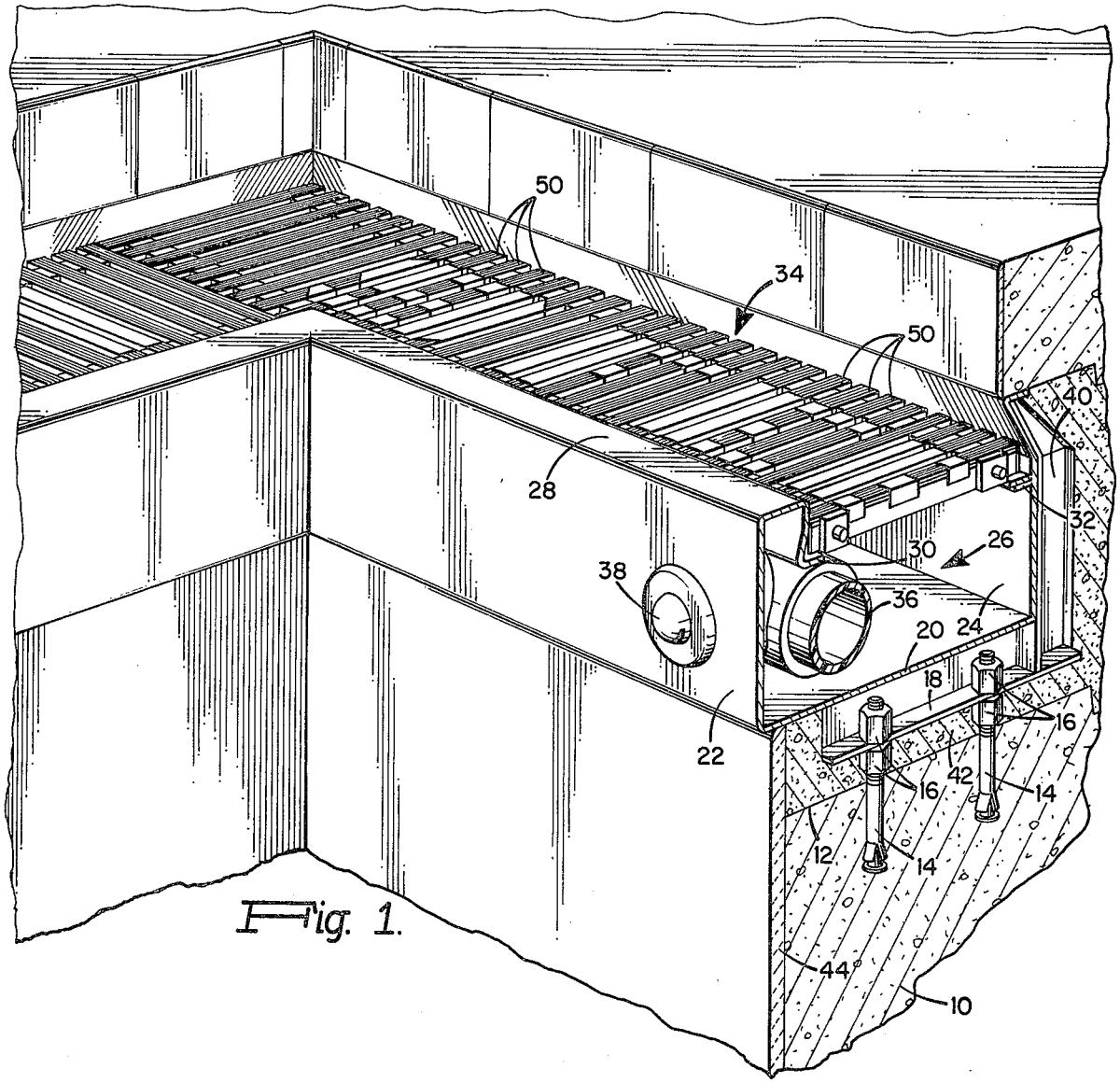
Fig. 1.
Fig. 2.
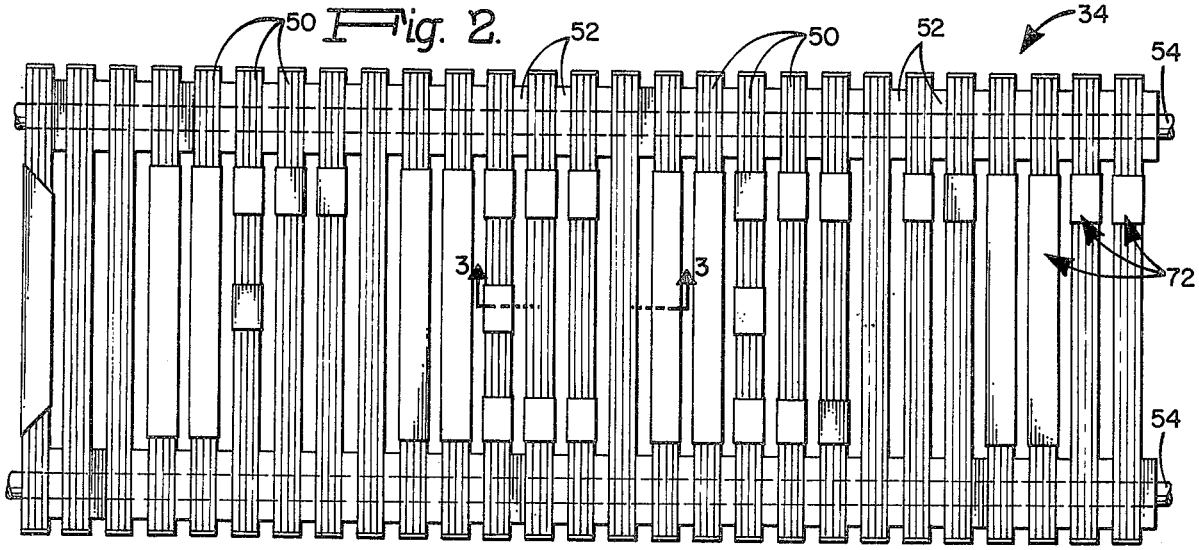

MEANS FOR APPLYING INDICIA TO SWIMMING POOL COMPONENTS

BACKGROUND OF THE INVENTION

This invention relates generally to swimming pools, and is concerned in particular with means for applying indicia to swimming pool components.

Conventionally, indicia such as for example depth markings, lane markers, etc. are applied to swimming pool components either by painting or in some cases where tile or masonry surfaces are available, through the use of colored tiles arranged in appropriate patterns. Painting has proven to be less than satisfactory because of the corrosive nature of treated swimming pool water which causes the paint to fade, crack and peel. This problem is particularly acute at outdoor pool facilities where the paint is also exposed to direct sunlight. Although colored tiles are more durable, this advantage is offset to a considerable extent by the fact that such tiles are expensive to install.

In modern pool installations, an ever increasing use is now being made of swimming pool components such as for example drain gutters and water supply assemblies, movable bulkheads, etc. which have grilled surfaces characterized by laterally spaced longitudinally extending grill members. A general object of the present invention is the provision of an improved means for applying suitable indicia to such grilled surfaces in a manner which obviates or at least substantially minimizes the problems associated with conventional techniques.

A more specific object of the present invention is the provision of specially designed channel-shaped cap members which can be extruded in arbitrarily selected lengths and thereafter cut to length for quick and easy appliction in appropriate indicia patterns to the grill members of swimming pool components.

Another object of the present invention is the provision of cap members of the type described above which are extruded of relatively low cost resilient plastic material.

Still another object of the present invention is the provision of means for applying indicia to the grills of swimming pool components, the said means being characterized by low cost, long useful life, and ease of applicability.

SUMMARY OF THE INVENTION

According to the present invention, there is provided means for applying indicia to swimming pool components of the type which have laterally spaced elongated grill members with each grill member having an exposed wall with side walls extending rearwardly therefrom. The aforesaid means includes channel-shaped cap members having spaced opposed resilient side flanges connected by an intermediate flat web. The side flanges have inwardly protruding longitudinally extending ribs arranged to snap into grooves in the side walls of the grill members. Such cap members may be conveniently and inexpensively extruded from any suitable plastic material and thereafter cut to length for application to the grill members in the patterns desired to develop appropriate indicia. The cap members may be cut with standard shears or the like and installed by relatively unskilled workmen. Once installed, the cap members resist cracking, peeling and fading and provide inexpensive attractive and long lasting indicia.

BRIEF DESCRIPTION OF THE DRAWINGS

An embodiment of the invention will now be described by way of example only, with reference to the accompanying drawings, wherein:

FIG. 1 is a view in perspective of a typical swimming pool component, in this case a swimming pool overflow drain gutter and water supply assembly, having a removable grill-type cover with indicia applied thereto in accordance with the present invention;

FIG. 2 is a plan view of a portion of the grill-type cover shown in FIG. 1;

DESCRIPTION OF PREFERRED EMBODIMENT

Figure 3:
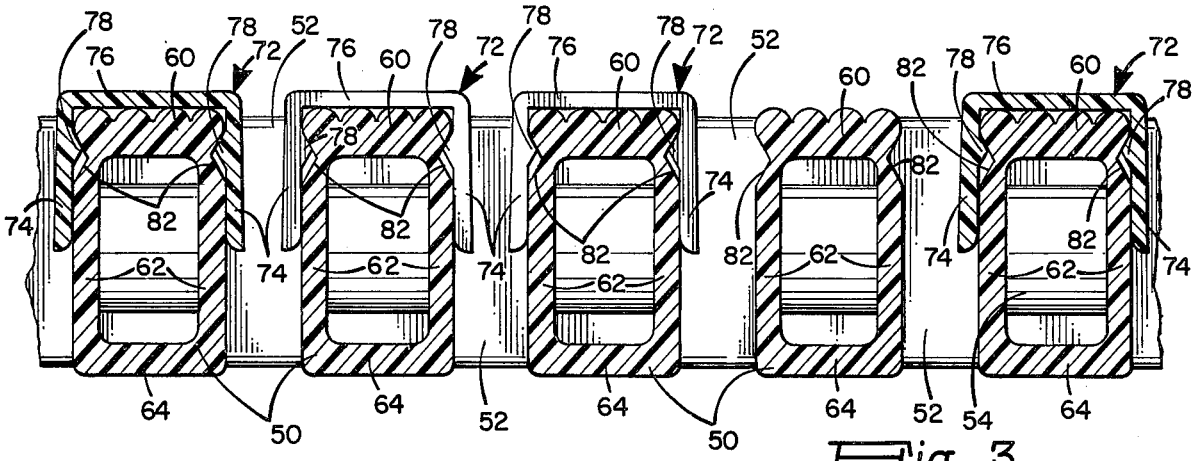
FIG. 3 is a sectional view taken along lines 3-3 of FIG. 2.

Referring initially to FIG. 1, there is shown one corner of a typical swimming pool installation. The pool wall 10 has an upper ledge 12 with embedded anchor bolts 14 extending vertically therefrom. The anchor bolts have nuts 16 threaded thereon to provide an adjustable support for an angle member 18 welded to a gutter bottom 20. The gutter bottom 20 cooperates with upstanding inner and outer gutter walls 22 and 24 to define a gutter channel 26 surrounding the pool perimeter. The inner gutter wall has an overflow lip 28 which terminates in a lower inwardly protruding support flange 30. Flange 30 cooperates with a bracket 32 on the outer gutter wall 24 to support a grill-type removable cover assembly generally indicated at 34. An inlet manifold 36 is removably mounted in the gutter channel 26 beneath cover assembly 34. The manifold 36 is connected to inlet nozzles 38 which protrude through the inner gutter wall 22. An additional vertical reinforcing element 40 is welded to the outer gutter wall 24 and the angle member 18. After the gutter body has been leveled by adjusting nuts 16, the gutter assembly is grouted in place as at 42, and the pool wall is finished as at 44 by an application of concrete gunite or tile. Water flows continuously from the pool surface over the overflow lip 28 and through the cover assembly 34 into the gutter channel 26 where it is removed by piping (not shown) to a conventional filtering system. After filtering, the water is returned to the pool via manifold 36 and inlet nozzles 38.

Figure 4:
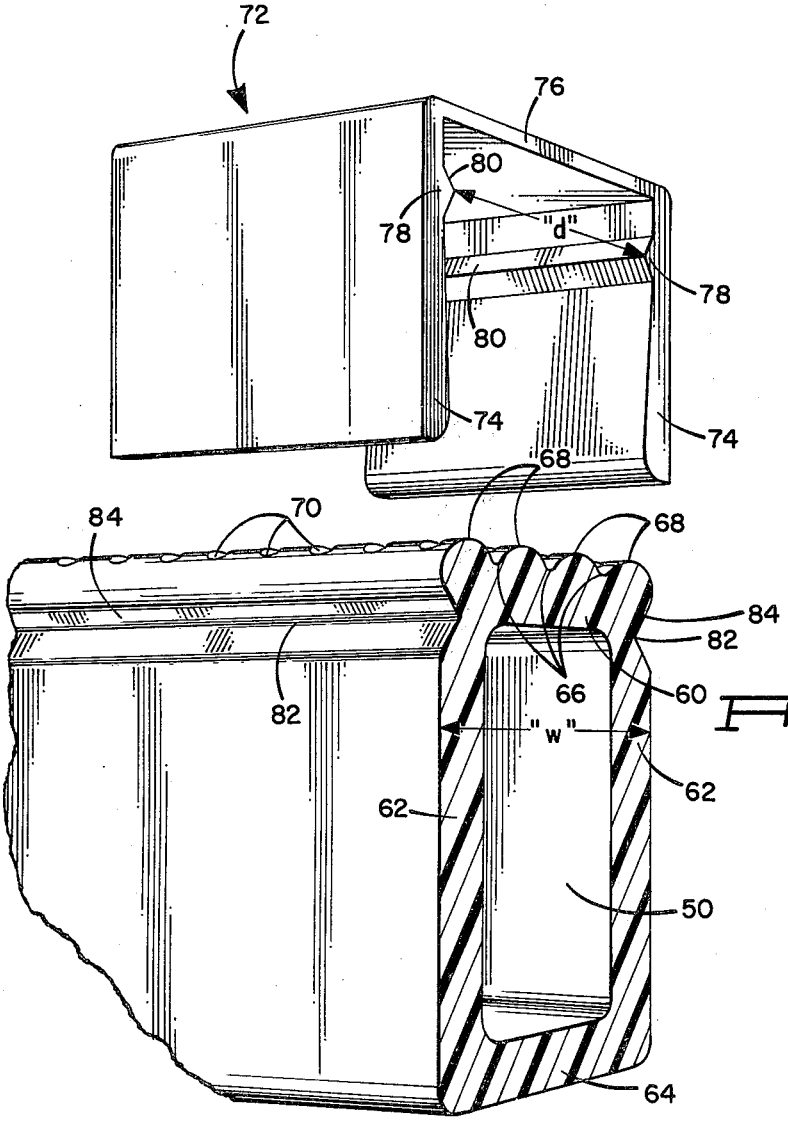
FIG. 4 is an exploded perspective view of a cap member and an underlying grill member.

The cover assembly 34 is comprised of a plurality of longitudinally extending parallel grill members indicated typically at 50 with intermediate spacers 52 all interconnected in standard lengths by transverse pins 54. Preferably, the grill members are extruded from a suitable plastic material. As is best shown in FIGS. 3 and 4, each grill member has an exposed wall 60, side walls 62 extending rearwardly or downwardly therefrom, and a back or bottom wall 64. Preferably, the exposed wall has longitudinal grooves 66 which form ridges 68 which are then notched transversally as at 70. The ridges 68 and transverse notches 70 provide an anti-skid surface which is desirable from a safety standpoint.

The drain gutter and water supply assembly heretofore described constitutes a swimming pool component which is now well known to those skilled in the art. The present invention deals with an improved means for applying indicia, for example depth markings, to a swimming pool component of this general type. Again with reference to FIG. 4, it will be seen that the present invention includes the provision of cap members generally indicated typically at 72. Each cap member is preferably extruded of a suitable plastic material in arbitrarily selected lengths which can then be cut to shorter lengths to make up any desired marking. The cap members are channel-shaped, with resilient side flanges 74 joined by an intermediate flat web 76. Opposed longitudinally extending ribs 78 are formed on the interior surfaces of the side flanges 74. Each rib 78 preferably has at least one "first" face 80 which is inclined inwardly at an angle relative to the intermediate web 76.

The side walls 62 of the grill members 50 are provided with grooves 82 arranged to receive the ribs 78 on the cap members 72. Each groove preferably has a "second" face 84 inclined inwardly at an angle relative to the plane of the exposed wall 60. The distance "*d*" between the innermost edges of the ribs 78 is less than the width "*w*" of the grill members 50 as defined by the side edges of the exposed wall 60 and the outer surfaces of the side walls 62.

During application, the cap members 72 are first cut into segments of appropriate length and where necessary, the ends of the segments are shaped to make up numbers, letters, etc. for use as depth markings or other desired indicia. Each segment is then simply pressed onto a grill member 50. When this is done, the side flanges 74 are momentarily deflected outwardly until the ribs 78 snap into the grooves 82. As the ribs 78 enter the grooves 82, the first and second faces 80 and 84 cooperate to partially translate the inwardly directed force of the resilient flanges 74 into a vertical force which pulls the web 76 against the underlying exposed wall 60. The cap member 72 is thus securely held in place. The transverse serrations 70 resist any tendency that the cap members 72 might have to shift longitudinally on the grill members 50.

If it should become necessary to change the pattern or make-up of the applied indicia, the cap members 72 can be pried from the grill members 50. Where a greater degree of permanence is desired, a solvent weld can be generated at the interface between the webs 76 and the exposed walls 60.

While the invention has been illustrated in connection with the removable grill 34 of a drain gutter and water supply assembly, it will be understood that this illustration is not to be interpreted as a limitation upon the overall use of the invention. The invention may be used on any swimming pool component of the type which embodies a grill or other like structure made up of laterally spaced members.

It is my intention to cover all changes and modifications of the embodiment herein chosen for purposes of disclosure which do not depart from the spirit and scope of the invention as claimed.

I claim:

1. The combination of a swimming pool component having parallel laterally spaced longitudinally extending grill members, each grill member having an exposed wall with side walls extending rearwardly therefrom and means for applying appropriate indicia to said component, said means comprising: a channel shaped cap member having spaced opposed side flanges connected by an intermediate flat web, a rib on the interior surface of each of said side flanges, and a groove on the exterior surface of each of said side walls, said ribs being arranged to be received in said grooves when said cap member is applied to a grill member with the underside of said intermediate flat web overlying and in face-to-face contact with said exposed wall, and with said side flanges overlying said side walls and means on said exposed wall arranged to contact the underside of said intermediate flat web for resisting movement of said cap member along said grill member.

2. The apparatus as claimed in claim 1 wherein said flanges are resilient, and wherein said ribs are oppositely disposed to each other, with the spacing between said ribs being less than the width of said grill members.

3. The apparatus as claimed in claim 1 wherein the said means is comprised of laterally spaced ridges extending longitudinally along the length of said exposed wall, said ridges being interrupted by transverse notches spaced along the length thereof.

4. The apparatus as claimed in claim 1 wherein said cap member is extruded of a resilient plastic material.

5. The apparatus as claimed in claim 1 wherein said ribs are oppositely disposed to each other with the distance therebetween being less than the width of said grill members.

6. The apparatus as claimed in claim 1 wherein said side flanges are resilient and wherein each of said ribs has a first face disposed at an angle with respect to said intermediate web, each of said grooves being defined in part by a second face disposed at an angle with respect to said exposed wall, said first and second faces cooperating in face to face contact to hold said web against said exposed wall when said cap member is applied to said grill member.

7. The combination of a swimming pool component of the type having parallel laterally spaced longitudinally extending grill members, with each grill member having an exposed wall with side walls extending rearwardly therefrom, and means for applying indicia to said component, said means comprising: a channel-shaped cap member having spaced opposed resilient side flanges connected by an intermediate flat web, opposed ribs on the interior surfaces of said flanges, the distance between said ribs being less than the width of said grill members, grooves on the exterior surfaces of said side walls, said ribs being arranged to snap into said grooves when said cap member is applied to a grill member with said intermediate flat web overlying and in contact with said exposed wall, and with said side flanges overlying said side walls, said intermediate flat web being solvent welded to said exposed wall to prevent movement of said cap member relative to said grill member.

* * * * *